US005313227A

United States Patent [19]

Aoki et al.

[11] Patent Number: 5,313,227

[45] Date of Patent: May 17, 1994

[54] GRAPHIC DISPLAY SYSTEM CAPABLE OF CUTTING OUT PARTIAL IMAGES

[75] Inventors: Yutaka Aoki, Fujisawa; Kazunori Takayanagi, Sagamihara, both of Japan

[73] Assignee: International Business Machines Corporation, Armonk, N.Y.

[21] Appl. No.: 119,445

[22] Filed: Sep. 9, 1993

Related U.S. Application Data

[63] Continuation of Ser. No. 794,349, Nov. 12, 1991, abandoned, which is a continuation of Ser. No. 331,932, Mar. 31, 1989, abandoned.

[30] Foreign Application Priority Data

Apr. 15, 1988 [JP] Japan ..... 63-91913

[51] Int. Cl.[5] ..... G09G 1/16

[52] U.S. Cl. ..... 345/118; 345/191; 395/135

[58] Field of Search ..... 345/118, 119, 115, 189, 345/190, 191; 395/134, 135; 382/33

[56] References Cited

U.S. PATENT DOCUMENTS

| | | | |
|---|---|---|---|
| 4,509,043 | 4/1985 | Mossaides | 340/729 |
| 4,616,262 | 10/1986 | Toriumi et al. | 340/716 |
| 4,641,255 | 2/1987 | Hohmann | 340/734 |
| 4,736,200 | 4/1988 | Ounuma | 340/721 |
| 4,745,575 | 5/1988 | Hawes | 340/744 |
| 4,751,507 | 6/1988 | Hama et al. | 340/724 |
| 4,789,954 | 12/1988 | Iida et al. | 364/720 |
| 4,799,056 | 1/1989 | Hattori et al. | 340/799 |
| 4,874,164 | 10/1989 | Miner et al. | 340/720 |
| 4,914,607 | 3/1990 | Takanashi et al. | 340/721 |
| 5,060,280 | 10/1991 | Mita et al. | 382/33 |

FOREIGN PATENT DOCUMENTS 145821 12/1983 European Pat. Off. .

OTHER PUBLICATIONS

IBM Tech. Disclosure Bulletin, vol. 24, No. 4, dated Sep. 1981, "Simplified Facsimile Terminal for Image Processing" by Ehara et al.

IBM Tech. Disclosure Bulletin, vol. 28, No. 6, dated Nov. 1985, "Graphic Bit-BLT Copy Under Mask".

Jee Journal of Elec. Engineering, vol. 24, No. 251, dated Nov. 1987, "Video Ram Chips Designed for Computer Graphics".

Article entitled "Visualization of Equi-Valued Surfaces and Stream Lines" by K. Koyamada.

Article entitled "Tetrahedral Grid Method for Equi--Valued Surface Generation" by A. Doi.

*Primary Examiner*—Alvin E. Oberley
*Assistant Examiner*—Steven J. Saras
*Attorney, Agent, or Firm*—Mark S. Walker; George E. Clark

[57] ABSTRACT

A graphic display system capable of cutting out a partial image according to the invention includes image storage means, outline drawing means for drawing an outline of the partial image to be cut out, mask data generator means for generating mask data according to the outline, and partial image write means for writing into the image storage means only a portion of the source image which is not masked by the mask data. The image storage means is an all point addressable (APA) memory in which a source image storage area for storing the source image, a work storage area for storing a dot pattern representing the outline, and a destination storage areas for storing the partial image are allocated. The mask data generator means generates mask data, whereby a region enclosed with the outline dot pattern is put in the non-masked state, while the rest is put in the masked state. The partial image write means may write the partial image and predetermined pattern data into the destination storage area by combining them.

7 Claims, 3 Drawing Sheets

GRAPHIC DISPLAY SYSTEM CAPABLE OF CUTTING OUT PARTIAL IMAGES

This is a continuation of application Ser. No. 07/794,349 filed Nov. 12, 1991 now abandoned, which is a continuation of application Ser No. 07/331,932 filed on Mar. 31, 1989 now abandoned.

FIELD OF THE INVENTION

The present invention relates to a graphic display system capable of cutting out a partial image and more particularly, to a graphic display system capable of cutting out any desired partial image by utilizing a raster operation.

PRIOR ART

In the field of image processing including graphics, an operation such as cut-and-paste is frequently performed by specifying a partial image on a screen of a display (especially, a color display). Conventionally, the partial image has been cut out by using software or a dedicated hardware. For example, U.S. Pat. No. 4,751,507 assigned to the same assignee as the present invention discloses a software technique in which a partial image is cut out and displayed at a different place on a screen with an enlarged scale. IBM Technical Disclosure Bulletin, Vol. 24, No. 4, pp. 1778–1782, published in September, 1981, discloses a technique for cutting out a partial image with dedicated AND gates.

If a partial image is cut out with software, there is a limitation in improvement of its speed. On the other hand, if it is performed with dedicated hardware, high speed processing is possible, but there is a lack of expandability and flexibility because its functions are fixed. In addition, it is expensive because additional hardware is provided.

SUMMARY OF THE INVENTION

Therefore, an object of the invention is to allow any desired partial image to be cut out by utilizing a raster operation function that an ordinary graphic display system has.

A graphic display system capable of cutting out a partial image according to the invention comprises image storage means, outline drawing means for drawing an outline of the partial image to be cut out, mask data generator means for generating mask data according to the outline, and partial image write means for writing into the image storage means only a portion of the source image which is not masked by the mask data. The image storage means is an all point addressable (APA) memory in which a source image storage area for storing the source image, a work storage area for storing a dot pattern representing the outline, and a destination storage areas for storing the partial image are allocated. The mask data generator means generates mask data, whereby a region enclosed with the outline dot pattern is put in the non-masked state, while the rest is put in the masked state. The partial image write means may write the partial image and predetermined pattern data into the destination storage area by combining them.

DETAILED DESCRIPTION OF A PREFERRED EMBODIMENT OF THE INVENTION

Figure 1:
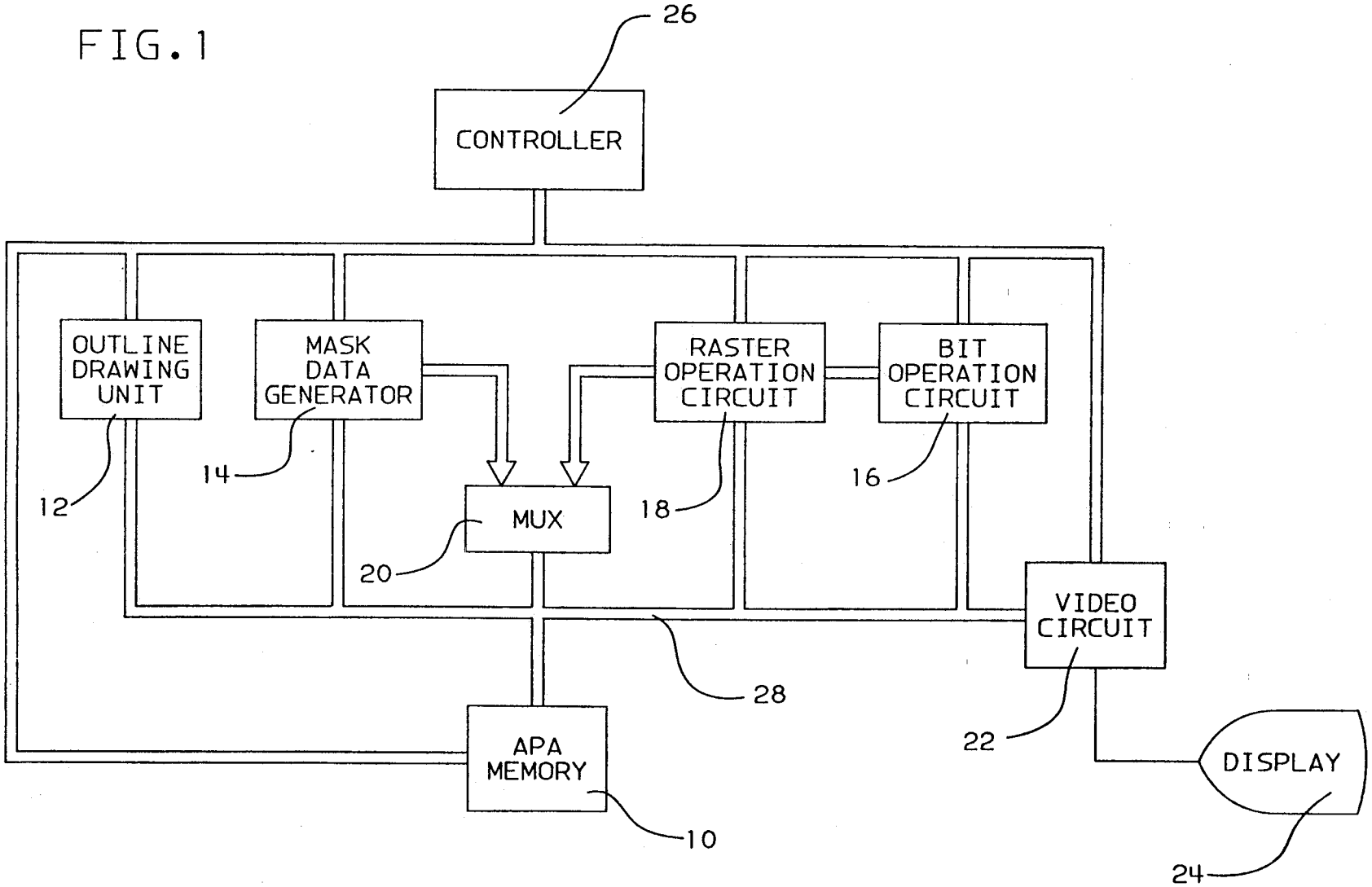
FIG. 1 is a block diagram illustrating an embodiment of the graphic display system according to the invention.

Referring to FIG. 1, there is illustrated a configuration of a graphic display system according to the invention. The system comprises an APA memory 10 for storing a source image from which a partial image is cut out, an outline drawing unit 12 for drawing an outline of the partial image to be cut out, a mask data generator 14 for generating mask data based on the outline data drawing by the outline drawing unit 12, a bit operation circuit 16 that allows bit-by-bit operations on the image data read from the APA memory 10, a raster operation circuit 18, a multiplexer (MUX) 20 for selecting either the mask data from the mask data generator 14 or the image data from the raster operation circuit 18 and supplying it to data input terminals of the APA memory 10, a video circuit 22 for converting the image data read from the APA memory 10 into signals for display, a display unit 24 for providing a visual display of the signals from the video circuit 22, and a controller 26 for controlling the entire system. Although the invention can be applied to either a color display system or a monochrome display system, the color displays system in which a pixel consists of n bits (for example, n=4) will be described below by way of example.

As is well known, in color display systems, the APA memory 10 consists of n memory planes. Each pixel data of n bits read from the APA memory 10 is converted into color data of m bits (for example, m=6) representing an actual display color by a palette circuit provided in the video circuit 22, and supplied to the display unit 24 after digital-analog conversion.

Figure 2:
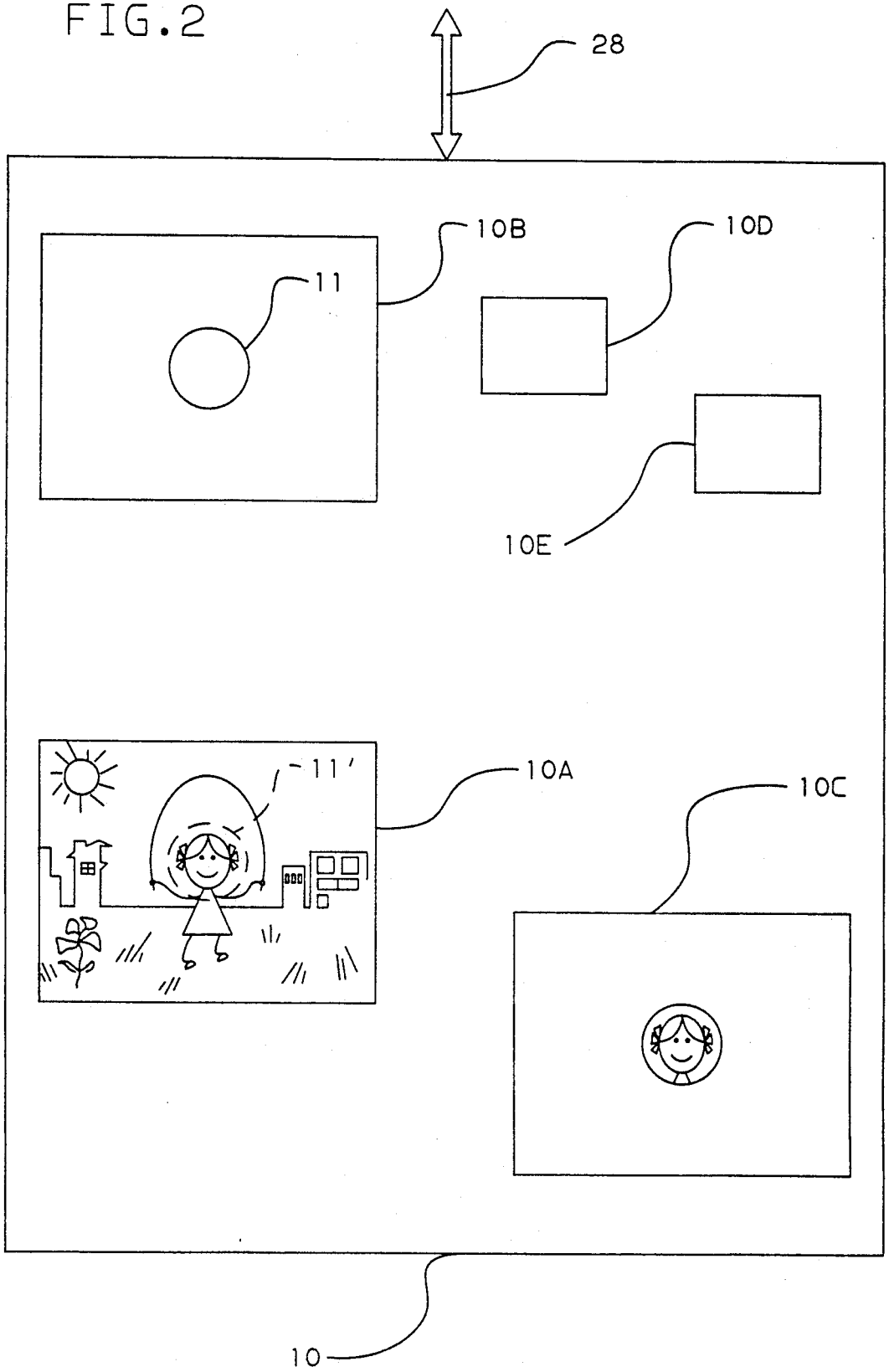
FIG. 2 is a block diagram illustrating the contents of APA memory 10.

Now, referring to FIG. 2, the cutting out of the partial image that is executed by the graphic display system of FIG. 1 is described. FIG. 2 illustrates the contents of the APA memory 10 which contains a source image storage area 10A, a work storage area 10B for drawing the outline of the partial image to be cut out, and a destination storage area 10C to which the cut out partial image is transferred. These storage areas 10A–10C are of the same size. The APA memory 10 may further contain pattern data 10D and 10E. These pattern data are combined with the source image data in the raster operation circuit 18.

When it is desired to cut out a partial image, the user first uses the outline drawing unit 12 to draw an outline (for example, a circle) defining a partial image that the user wants to cut out from a source image stored in the storage area 10A. The outline drawing unit 12 may be a hardware drawing facility that is usually provided in the graphic display system. Japanese Published Unexamined Patent Application No. 61-261779 assigned to the same assignee as the present invention discloses a technique for drawing a quadratic curve including a circle by using such a hardware drawing facility. If it is desired to interactively draw the outline while viewing the screen of the display 24, a mouse may be used as the outline drawing unit 12. In any case, the dot pattern 11 representing the outline drawn by the outline drawing unit 12 is written in the work storage area 10B. The location of the outline dot pattern 11 in the work storage area 10B corresponds to that of the partial image 11' in the source image storage area 10A. In this embodiment, one dot consists of n bits, but as far as the outline dot is concerned, it may be a single bit. In that case, the outline dots are written in a selected one of the n memory planes. In cases where one dot consists of n bits, it is sufficient to assign a specific color code of n bits to the outline dot.

The outline dot pattern 11 written in the work storage area 10B has an even number of outline dots per line when it is viewed laterally. For example, in a case of a circle, it is easily recognized that the number of dots turned on is two per line except for the upper and lower ends. At the upper and lower ends, writing is performed in the work storage area 10B so that two adjacent or close dots are turned on. Although two or more adjacent dots may be turned on to approximate a curve in an ordinary drawing facility, only the outermost dot is turned on when the outline of the partial image is drawn. This satisfies a condition to make the number of outline dots per line even. This condition is required to distinguish on each line the start and end points of a region enclosed with the outline. In this embodiment, an even-numbered dot including No. 0 represents the start point while an odd-numbered dot represents the end point.

After the writing of the outline dot pattern is completed, the contents of the work storage area 10B in the APA memory 10 are read out to the mask data generator 14 under control of the controller 26. It is assumed here that a unit of access for the APA memory 10 is one word (16 bits). The controller 26 reads the words one by one beginning from the address at the upper left corner of the work storage area 10B or its start address, and supplies it to the mask data generator 14. The mask data generator 14 checks whether the read word contains the even or odd numbered outline dot. Then, it generates mask data that put on each line a region from the even-numbered outline dot to the next odd-numbered one in the non-masked state, and the rest in the masked state.

Figure 3:
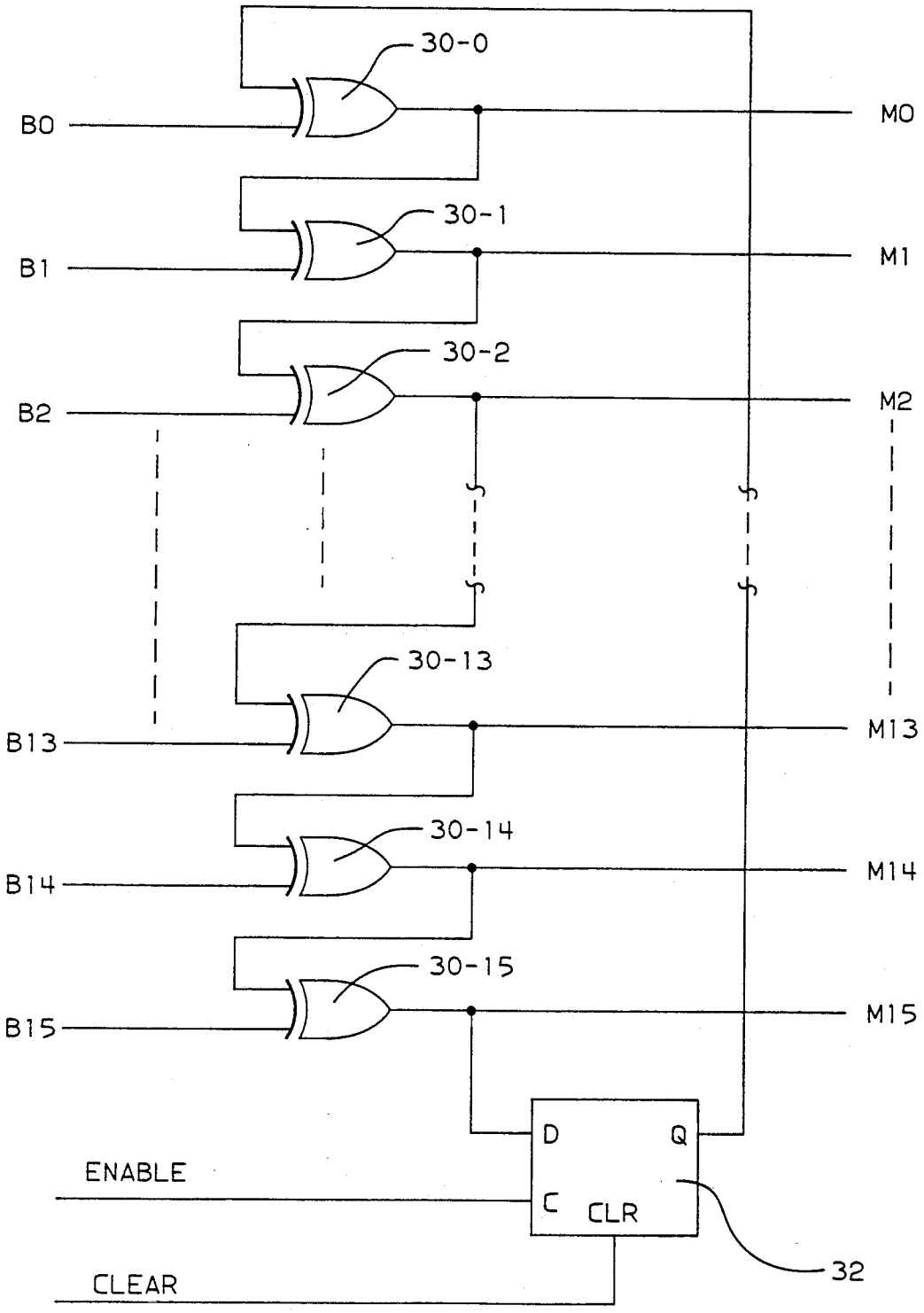
FIG. 3 is a circuit diagram illustrating an example of mask data generator 14.

FIG. 3 shows an illustrative configuration of the mask data generator 14. In the example shown, the mask data generator 14 consists of 16 exclusive OR gates 30-i (i=0, 1, . . . 15) and a latch 32. The exclusive OR gates 30-i are cascade connected in which the output of each gate becomes the input of the next gate. The output of the last exclusive OR gage 30-15 is fed to the first exclusive OR gate 30-0 through the latch 32. The second input of each gate is supplied with a corresponding bit B0–B15 in a word read from the work storage area 10B. Outputs M0–M15 of the exclusive OR gates 30-i form a word of mask data.

When the mask data generator 14 is to be operated, the latch 32 is first cleared prior to the operation. In a situation where the work storage area 10B is not read, the mask data bits M0–M15 are all 0's because B0–B15 and Q output of the latch 32 are all 0's. This condition is maintained as long as the 16 bits B0–B15 of each word read from the work storage area 10B are all 0's. Now, it is assumed that a read word contains the first or number 0 outline dot. Then, a corresponding bit Bi is 1 so that the output Mi of the exclusive OR gate 30-i, which receives it as its input, becomes 1. Because the output Mi is fed to the next exclusive OR gate 30-(i+1), its output Mi+1 also becomes 1 as long as its second input Bi+1 is not 1, that is, the next odd-numbered outline dot is not contained. Similarly, up to the last exclusive OR gate 30-15, as long as the next odd-numbered outline dot is not contained, the mask data with Mi-M15 being all 1's is generated. When writing to the APA memory 10 using the mask data, which will be described later, is completed, an enable signal is generated and applied to a clock input C of the latch 32. This sets the latch 32 which then supplies the Q output of 1 to the first exclusive OR gate 30-0. This is to maintain the previous state in preparation for the next word reading. Under this condition, even if an all 0 word is read next, an all 1 mask data is generated.

If a word containing an even-numbered outline dot or its subsequent word contains the next odd-numbered outline dot, the output Mj of the exclusive OR gate 30-j which receives a corresponding 1 bit at Bj, becomes 0 because another input from the previous stage is also 1. Thus, as long as the same word does not contain the next even-numbered outline dot, a mask data with MJ to M15 being all 0's is generated. When M15 becomes 0, the latch 32 is reset and its Q output being 0 is supplied to the first exclusive OR gate. Under such a condition, 0 mask bits are generated until an even-numbered outline dot is next detected.

As clearly seen from the above, the mask data generator 14 generates 0 mask bits which represent the masked state, for the outside of the outline dot pattern 11 written in the work storage area 10B, and 1 mask bits which represent the non-masked state, for the inside of the outline dot pattern 11. A word of mask data M0–M15 from the mask data generator 14 is supplied to the data input terminals of the APA memory 10 through the multiplexer 20 and the bus 28.

In this embodiment, the APA memory 10 is a dynamic RAM having write per bit capability, in which only a data input terminal receiving a 1 mask bit can perform writing. Whenever a mask data word is generated, the controller 26 reads a corresponding image data word of 16 bits from the source image storage area 10A and supplies it to the bit operation circuit 16. The bit operation circuit 16 is a hardware facility which allows a bit boundary transfer for the image data from the APA memory 10 which is accessed only at a word boundary. Such hardware is well known in the bit block transfer technique (generally called BitBlt), detailed description of which is omitted.

The image data from the bit operation circuit 16 is entered into the raster operation circuit 18. The raster operation circuit 18 performs a specific logic operation on the image data read from the APA memory 10 and other image data (such as a predetermined pattern data), and supplies its result to the multiplexer 20. A logic operation such as pass (allowing a selected image data to pass through as it is), AND, OR or exclusive OR is specified by the controller 26. Thus, a partial image can be cut out from the source image as it is without any change, or in an overlapped manner with a desired pattern. Examples of such a raster operation circuit are disclosed in Japanese Published Unexamined Patent Application No. 62-245375 assigned to the same assignee as the present invention, and IBM Technical Disclosure Bulletin, Vol. 27, No. 7A, pp. 4019–4020, December 1984.

The image data word from the raster operation circuit 18 is supplied to the data input terminals of the APA memory 10 through the multiplexer 20 and the bus 28. At that moment, the controller 26 sends a write command and an appropriate address of the destination storage area 10C to the APA memory 10. Thus, writing of the image data is performed at the data input terminals that have received the 1 mask bits representing the non-masked state.

The above operation is repeated until the last word in each storage area is reached in the order of (1) reading one word from the work storage area 10B, (2) generating a mask data, (3) reading a corresponding image data word from the source image storage area 10A, and (4) writing non-masked image data bits into the destination storage area 10C. When this is completed, the destination storage area 10C has been written with the partial image cut out from the source image.

Although, in the embodiments heretofore described, the work storage area 10B of the APA memory 10 is provided separately from the source image storage area 10A and the destination storage area 10B, it may be allocated the same area as either one of them. It is noted, however, if the work storage area 10B is allocated the same area as the source image storage area 10A, it is necessary to use a color code not used in the source image for the outline dots because the outline dots are represented by a color code of n bits. In case of a monochrome system, the work storage area 10B cannot be the same as the original image storage area 10A.

Also, in the above-mentioned embodiments, the outline of the partial image is a circle, but any desired outline such as an ellipse, rectangle or doughnut shape may be drawn. However, in case of the rectangle, dots of upper and lower horizontal sides are not written in the work storage area 10B. Generated for the upper side are mask data that put a region between the uppermost ends of the left and right sides in the non-masked state, and for the lower side are mask data that put a region between the lowermost ends of the left and right sides in the non-masked state.

As described, the invention permits cutting out any desired partial image from a source image at a high speed without imposing a burden on software.

What is claimed:

1. A graphic display system comprising:

storage means for storing a plurality of image defining bits, said storage means having a first storage area for storing a source image, a second storage area for storing a dot pattern defining a partial image area outline of a partial image to be cut out from said source image, and a third storage area for storing said cut out partial image, said third storage area being displaced from said first storage area;

mask data generator means for reading a fixed size block of bits of said second storage area and generating a fixed size mask data block defining a non-masked state in a region enclosed by said dot pattern and a masked state in the remainder;

bit block transfer means for transferring fixed size blocks of bits of said source image from said first storage area to said third storage area, said fixed size blocks being the same size as said fixed size mask data block;

raster operation means for logically manipulating each of said bits of said fixed size blocks of said source image being transferred to produce a modified fixed size block;

said bit block transfer means, said mask generator means and said raster operation means synchronously operating such that each fixed size block of said source image is manipulated by said raster operation means and written to said third storage means before a next fixed size block is manipulated;

write control means for controlling writing into said third storage means, said write control means responsive to said fixed size mask data block so that said bit block transfer means transfers into said third storage area only the portion of said modified fixed size block corresponding to the non-masked state of said fixed size mask data block; and multiplexer means for alternately connecting said fixed size mask and said modified fixed size block to said write control means.

2. A graphic display system set forth in claim 1, wherein the dot pattern written in said second storage area contains an even number of outline dots per line.

3. A graphic display system set forth in claim 2, wherein when said mask data generator means reads said second storage area, it puts the area from an even-numbered outline dot to the next odd-numbered outline dot in the non-masked state.

4. A graphic display system set forth in claim 1 wherein said first storage area includes said second storage area.

5. A graphic display system set forth in claim 2 wherein said first storage area includes said second storage area.

6. A graphic display system set forth in claim 3 wherein said first storage area includes said second storage area.

7. A method for extracting a portion of an image from a graphics image stored in a graphics system having storage, a processor, operator interaction means, and a display, said image comprising a plurality of lines each containing a plurality of pixels, the method comprising the steps of:

receiving outline definition signals from said operator interaction means;

storing said outline definition signals in a portion of said storage to create an image portion outline;

performing the following steps for each line of said image;

reading a block of outline pixels of said image portion outline from said storage;

generating a mask block from said block of outline pixels, said mask block being in an on condition outside of said image portion outline and an off condition within said image portion outline;

reading a block of image pixels of said image from said storage area, said block of image pixels corresponding to said block of outline pixels;

applying a logical raster operation to said second block of pixels; and writing to a destination storage area to those pixels corresponding to the mask-off portion of said mask data block.

* * * * *